US005078520A

United States Patent [19]

Yano et al.

[11] Patent Number: 5,078,520

[45] Date of Patent: Jan. 7, 1992

[54] APPARATUS FOR DRIVING PRINTING HEAD OF WIRE-DOT IMPACT PRINTER

[75] Inventors: Akio Yano, Tokyo; Kouji Hosokawa, Tochigi, both of Japan

[73] Assignee: Fujitsu Limited, Kawasaki, Japan

[21] Appl. No.: 492,130

[22] Filed: Mar. 13, 1990

[30] Foreign Application Priority Data

Mar. 16, 1989 [JP] Japan ..... 1-062006
Mar. 16, 1989 [JP] Japan ..... 1-062017

[51] Int. Cl.[5] ..... B41J 3/12

[52] U.S. Cl. ..... 400/124; 101/93.05; 310/314; 395/108

[58] Field of Search ..... 400/124, 279, 157.2; 101/93.05; 310/314, 316, 317, 318; 364/519

[56] References Cited

U.S. PATENT DOCUMENTS

| | | | |
|---|---|---|---|
| 4,272,200 | 6/1981 | Hehl | 400/124 |
| 4,435,666 | 3/1984 | Fukui et al. | 310/320 |
| 4,579,467 | 4/1986 | Furukawa | 400/124 |
| 4,586,835 | 5/1986 | Alexander et al. | 400/124 |
| 4,781,477 | 11/1988 | Nagasawa | 400/124 |
| 4,810,113 | 3/1989 | Itoh et al. | 400/124 |
| 4,844,635 | 7/1989 | Malkemes et al. | 400/124 |
| 4,877,943 | 10/1989 | Hori | 400/124 |
| 4,886,380 | 12/1989 | Chu | 400/124 |
| 4,940,343 | 7/1990 | Kikuchi et al. | 400/124 |

OTHER PUBLICATIONS

"Timing Generation Logic for Dot Matrix Printer" IBM Tech. Discl. Bulletin, vol. 32, No. 1, 6/89, pp. 120–122.

*Primary Examiner*—Eugene H. Eickholt
*Attorney, Agent, or Firm*—Staas & Halsey

[57] ABSTRACT

An apparatus for driving a printing head of a wire-dot printer, the head including a plurality of electroexpansive elements for driving respective printing wires cooperatively constituting a wire-dot matrix and in accordance with print pattern data designating the existence, or non-existence, of a dot to be printed by the respective, plural dot-impact printing wires in each of a succession of print cycles. Each electroexpansive element, selectively, is expanded and shrunk by an electrical charge/discharge, thereby to move the respective printing wire and perform a dot printing operation. The time intervals T1 and T2 respectively for the charge and discharge in each of a succession of printing cycles are: in the case of continuous dots, T1=A, T2 −B′ for the first dot, T1=A′, T2−B′ for successive dots intermediate the first and the last dots, and T1=A′, T2−B for the last dot of the continuous dots, and in the case of a single dot, T1=A, T2=B, wherein A>A′, and B>B′.

5 Claims, 7 Drawing Sheets

APPARATUS FOR DRIVING PRINTING HEAD OF WIRE-DOT IMPACT PRINTER

BACKGROUND OF THE INVENTION

1. Field of the Invention

This invention relates to a wire-dot printer and, more particularly, to an apparatus for and method of driving a printing head of such a wire-dot printer including actuating devices for driving dot-impact wires or rods, the actuating devices each comprising an electroexpansive element which is expanded and shrunk, respectively, by electrically charging and discharging same.

2. Description of the Related Art

Recently, high-speed wire-dot printing heads have become more widely used, and accordingly, to drive the dot-impact wires of such a high-speed printing head, actuating means comprising electroexpansive elements have been developed and used instead of the usual electromagnetic type driving elements.

For example, U.S. Pat. No. 4,435,666 and page 92 of a publication "NIKKEI (Japan Economic) MECHANICAL" issued on Mar. 12, 1984, suggest that a printing head including such electroexpansive elements can be used. This electroexpansive element is made by following the steps of preparing a plurality of green sheets made of piezo-electric ceramics, forming a metal paste film on one of the surfaces of each of the green sheets thereby to form an inner electrode, and laminating and sintering the plurality of green sheets.

To make a printing head using such an actuating device, the provision of means for effectively enlarging the very small physical, or mechanical, displacement produced by the expansion and shrinking of such an electroexpansive element is essential. Further, very sophisticated drive means are necessary to meet the requirements for high speed wire-dot printing.

SUMMARY OF THE INVENTION

An object of the present invention is to provide an improved apparatus for and method of driving a printing head of a wire-dot printer employing electroexpansive elements for driving dot-impact wires or rods and means for effectively enlarging the very small displacement of the electroexpansive elements which drive the dot-impact wires or rods, which apparatus and method afford improved operation by appropriately setting the timing for the charging and discharging of the electroexpansive elements.

Another object of the present invention is to provide an apparatus for and method of driving the printing head of a wire-dot printer, which afford stable operation of the printing wires to thereby improve the printing quality.

According to the present invention, there is provided an apparatus for and method of driving a printing head of a wire-dot printer including a plurality of electroexpansive elements for driving the respective dot-impact printing wires and which cooperatively constitute a wire-dot matrix, wherein each of the electroexpansive elements is expanded and shrunk by electrically charging and discharging same, respectively, to move an impact printing wire connected to the electroexpansive element and which thereby conducts a printing operation. This apparatus comprises a means for detecting the existence of a dot, in each printing cycle, thereby to determine whether successive dots appear throughout respective and successive printing cycles or only a single dot appears in the printing cycle, and a means for setting the respective time internals (T1 and T2) for electrically charging and discharging the corresponding electroexpansive elements, as follows: in the case of a series of continuous dots, $T1=A$, $T2=B'$ for the first dot, $T1=A'$, $T2=B'$ for the second or later (i.e., successive) dot or dots, and $T1=A'$, $T2=B$ for the last dot of the series, and in the case of a single dot, $T1=A$, $T2=B$, wherein T1 is the time for electrically charging, T2 is the time for electrically discharging, $A>A'$, and $B>B'$.

In this invention, if the dot appearance is continuous (i.e., a series of successive dots are produced in a corresponding series of respective, successive print cycles), the discharge interval is terminated before the electroexpansive element is fully discharged, and therefore, the element does not shrink completely to its original (unenergized) state and accordingly the associated impact printing wire does not return to its initial position before the next successive print cycle, whereby an overshoot of the impact printing wire is prevented. In the next print cycle, since the charge time is reduced as a result of the incomplete discharge during the previous cycle, the mechanical parts of the printing head are not subjected to an excess load and thus the amplitude of displacement (i.e., movement) of the printing wire can be reduced. Also, at the occurrence of the last dot of the continuous succession of dots and thus for the corresponding last print cycle, the discharge time is not shortened, and thus a stable and reliable operation of the printing wire is ensured.

In another aspect of the present invention, there is provided an apparatus for driving a printing head of a wire-dot printer having a plurality of electroexpansive elements for driving respective dot-impact printing wires which cooperatively constitute a wire-dot matrix, and each of these electroexpansive elements is expanded and shrunk by selectively, electrically charging and discharging same, thereby to move the respective impact printing wire connected to the electroexpansive element in such a manner that the motion of the electroexpansive element is enlarged by an enlarging means and transmitted to the impact printing wire to conduct a printing operation. This apparatus more particularly comprises a means for controlling the respective time intervals of electrical charging and discharging of the electroexpansive elements in such a manner that the electrical charging is continued once it is started at a time (a) so that the impact printing wire performs an impact operation, and after the impact operation, at a time c' immediately before a time (c) when the impact printing wire reaches a maximum retracted position, the electric discharge of said electroexpansive element is started.

In this aspect, since the shrinkage of the electroexpansive element is started immediately before the printing wire reaches the most retracted position (c), a force for moving the printing wire forward due to the remaining energy and an opposite force for moving it in the opposite direction due to the shrinkage of the electroexpansive element are mutually balanced, and thus the remaining energy is considerably reduced. Therefore, the kinetic energy of the printing wire, per se, is almost extinguished, and as a result, the printing wire can be quickly returned to its initial position.

DETAILED DESCRIPTION OF THE PREFERRED EMBODIMENTS

Figure 1:
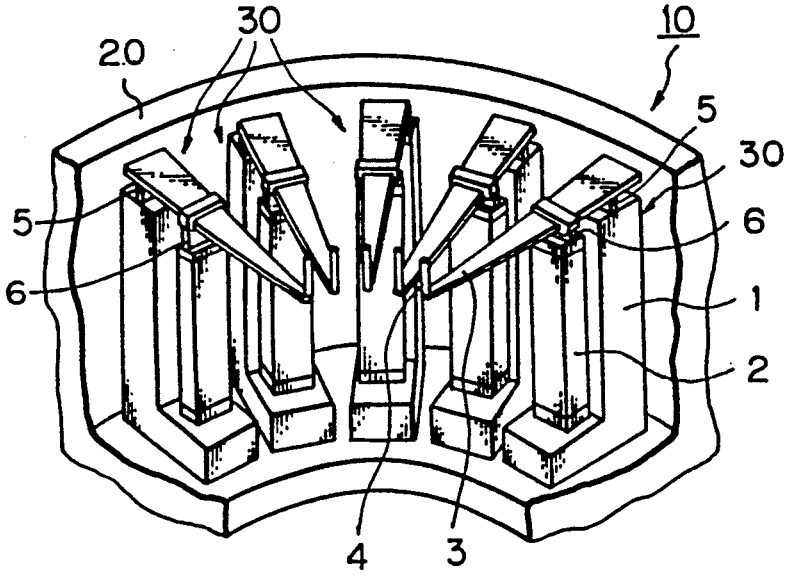
FIG. 1 is a partial perspective view of a printing head, and particularly of an actuator for driving dot-impact wires or rods of the printing head.
Figure 2:
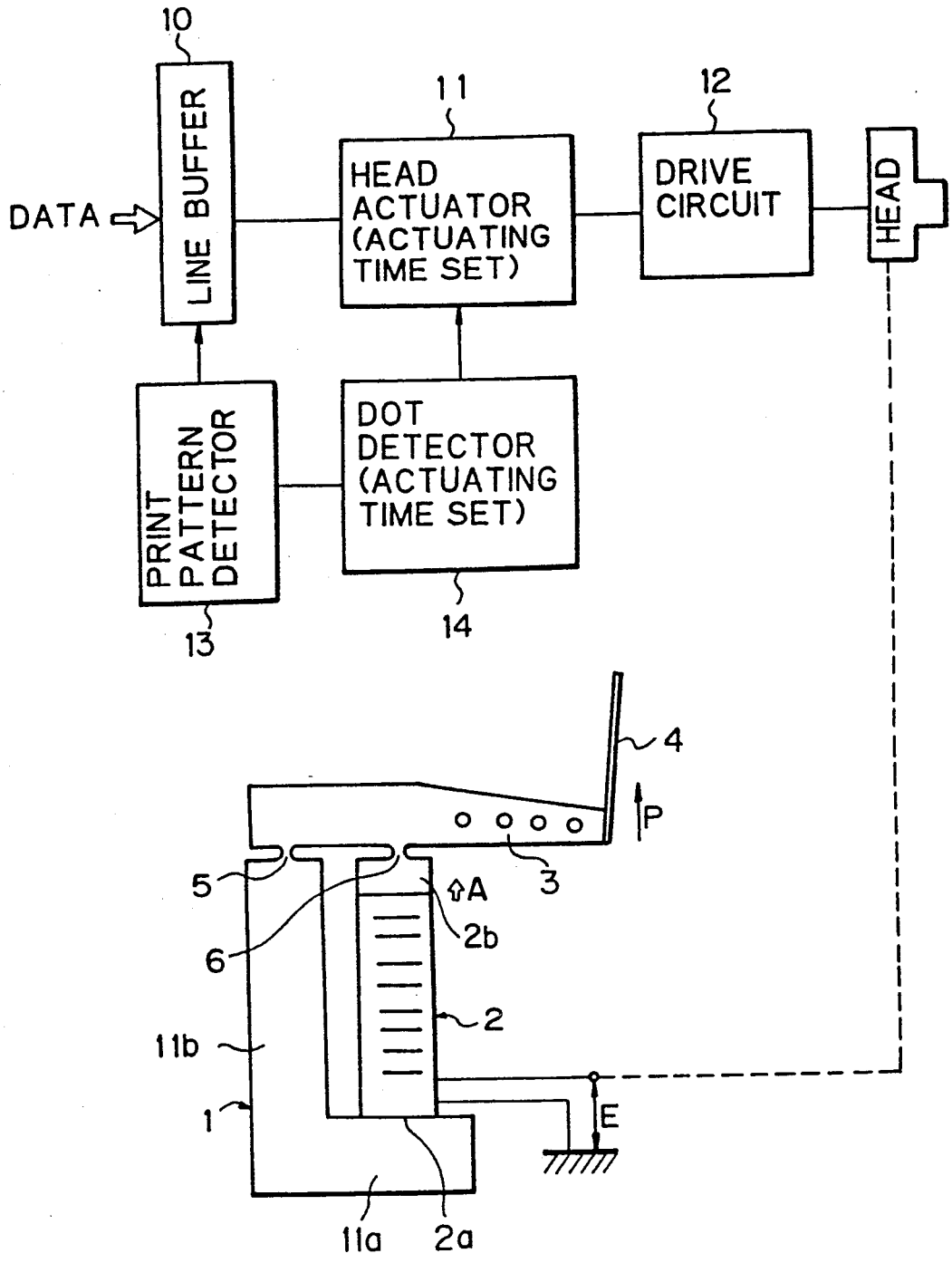
FIG. 2 is a schematic view of the printing head and a block diagram illustrating a drive apparatus for actuating dot-impact wires according to the present invention.

Referring now to FIGS. 1 and 2, which illustrate a printing head of a dot-impact printer according to the present invention, the printing head, generally indicated by reference numeral 10, comprises a substantially cylindrical housing 20 and a plurality of actuators 30 arranged radially in the cylindrical housing 20. Each of the actuators 30 comprises a base frame 1, an electroexpansive element 2, a movable member (or armature) 3, an impact printing wire or rod 4, and hinge members 5 and 6.

The frame 1, as seen in FIG. 2, is substantially L-shaped and has a base 11*a* and a side wall 11*b* extending upwardly and substantially perpendicularly to the base 11*a*. The electroexpansive element 2, such as a piezoelectric device, has a base portion 2*a* which is rigidly mounted on the frame base 11*a*, and therefore, the top free end 26 of the electroexpansive element 2 is displaced upwardly as shown by arrow A when electrical power is applied to the element 2. The armature 3 is connected at one end to a top of the side wall 11*b* by the hinge 5, and to the top of the electroexpansive element 2 by the hinge 6, which is positioned relatively near or adjacent, to the hinge 5. Therefore, a displacement of the electroexpansive element 2 is enlarged by the armature 3 and transmitted to the impact printing wire 4 fixed to the free end of the armature 3. A plurality (for example, for printing 24×24 dots) of such printing wires 6 driven by respective actuators 30 constitute a wire-dot matrix, as is well known in the prior art.

Figure 3:
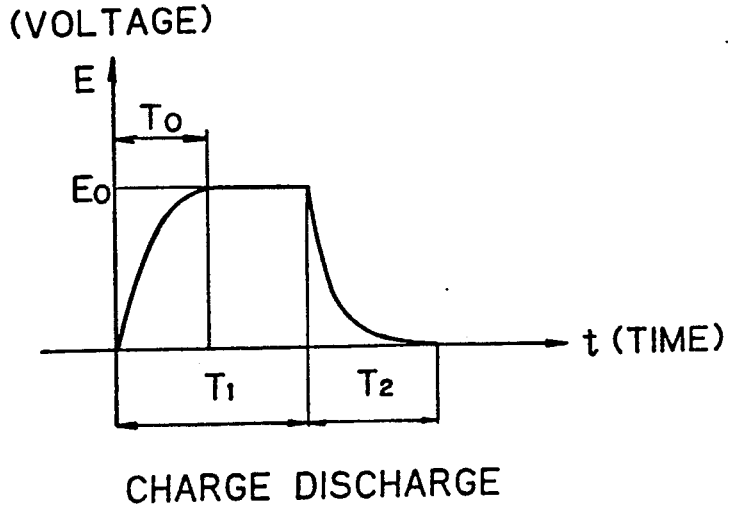
FIG. 3 is a diagram illustrating the operation of an electroexpansive element.

As shown in FIG. 3, in one printing cycle, electrical power is applied for charging the electroexpansive element 2 for a predetermined time T1. In this case, the upper portion of the electroexpansive element 2 is displaced upwardly, and therefore, the armature 3 is turned in the counterclockwise direction (in FIG. 2) about the hinge 5. Accordingly, the displacement of the electroexpansive element 2 is enlarged by the armature 3 and transmitted to the impact printing wire 6, which is moved in the upward direction as shown by an arrow P to conduct a dot-printing. In FIG. 3, after the predetermined time T1, the electrical power is disconnected from the electroexpansive element 2 and element 2 discharges for a predetermined time T2, and thus the armature 3 shrinks, and accordingly the armature 3 returns in the clockwise direction (in FIG. 2) to its original position.

Figure 4:
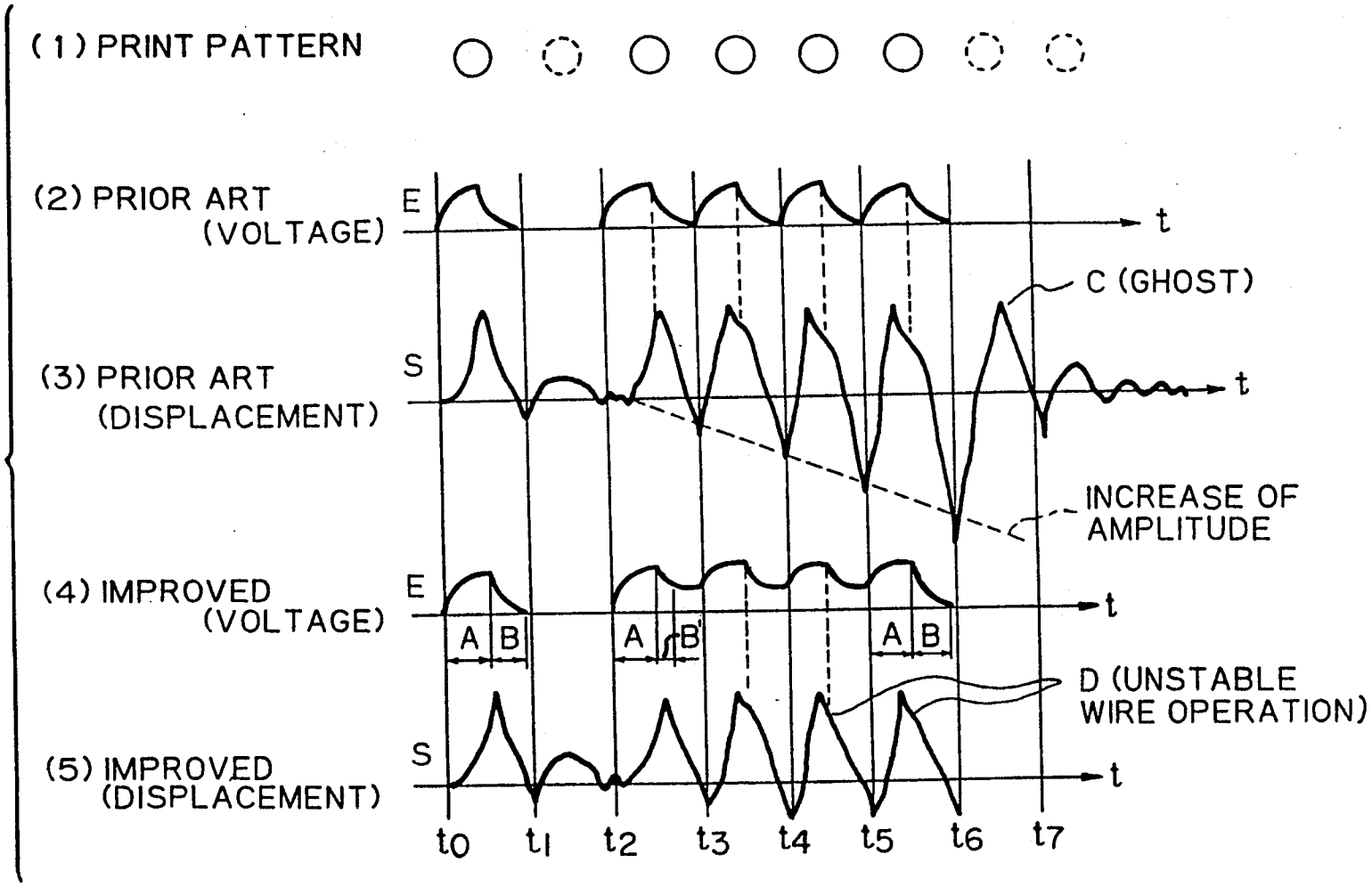
FIG. 4 illustrates operations of a printing head driven, variously and by way of comparison according to the prior art and to a prior improvement thereof.

FIG. 4 illustrates the operation of the printing heads, both as in the prior art and in accordance with the present improvements thereto, in which the respective abscissa of plots (1) to (5) indicate the common intervals of time (t). In FIG. 4, (1) shows a print pattern variously of continuous and discontinuous dots, wherein a solid circle indicates the existence of a print dot and a dotted circle indicates the nonexistence of a print dot; (2) illustrates the charging and discharging voltage waveforms, i.e., as produced by the voltage applied to the electroexpansive element, in the prior art; (3) illustrates the corresponding displacement amplitude S of the printing wire in the prior art; (4) illustrates the charging and discharging voltage waveforms, i.e., as produced by voltage E applied to the electroexpansive element, in an improved printing head disclosed in Japanese Patent Application No. 63-282369, filed on Nov. 10, 1988, by the assignee of this application; and (5) illustrates the corresponding, improved displacement amplitude S of the print wire of this improved printing head.

As understood from (2) and (3) of FIG. 4, in the printing head of the prior art, the electrical charging and discharging of the electroexpansive element is conducted in the same manner as in FIG. 3, regardless of the existence of continuous or discontinuous dots. In the case of a discontinuous or single dot produced in the first print cycle (i.e., during time internal "t0" to "t1"), the free end of the armature 3 has returned at time t1 to a position slightly lower than the initial position at time t0, i.e., a slight overshoot of the armature 3 occurs. In the next cycle, however, a dot does not exist, and therefore, the electrical charging or discharging is not conducted, and thus the overshoot of the armature 3 dissipates and no longer has any affect on the next (discontinuous) print cycle starting at tz.

In the case of the continuous dots (produced in the successive cycles t2–t3, t3–t4, . . . ), however, immediately after the free end of the armature 3 overshoots when returning the wire 4 (e.g., at time t3 as to cycle t2–t3), the electrical charging begins for the next cycle (i.e., the cycle t3–t4, for this example), and therefore, the displacement of the wire 4 produced by the second (i.e., each next-successive) charge becomes larger than that due to the previous (i.e., each respectively next-preceding) charge, and thus the overshoot of the armature 3, i.e., the amplitude (of movement, or displacement) of the wire 4, becomes larger and larger in the successive cycles (i.e., t3–t4, t4–t5, . . . ), as shown by the angularly downwardly extending dotted line labelled "INCREASE OF AMPLITUDE." Finally, the accumulated overshoot becomes significantly large at the last dot of the continuous dots, and therefore, at the next cycle in which there is no dot (i.e., cycle t6–t7), although an electric charge is not applied to the electroexpansive element, the wire 4 may move upwardly, and thus in the printing direction, due to the energy accumulated in the armature 3 by the excess stress imposed by the overshooting, and accordingly, a "ghost" dot may be printed and thus appear at a point C, which reduces the print quality.

According to the improvements shown by plots (4) and (5) of FIG. 4, in the case of the discontinuous (single) dot, the charge time A and the discharge time B are the same as in plot (2), but in the case of the continuous dots (e.g., at t2–t3, t3–t4 . . . t5–t6), the discharge is completed sooner in each cycle, i.e., the discharge time B′ (in cycle t2–t3) is shorter than the time B (in the single dot cycle t0–t1 and also in the last cycle t5–t6 of the series of continuous dots). The operation (i.e., the displacement amplitude S) of the wire 4 thus is improved, compared to the above-mentioned case (3). Nevertheless, when considering the discharge operation, in some printing cycles a full discharge is made, but in other cycles the discharge operation terminates before a full discharge is obtained. Accordingly, the initial operating conditions of the wire become uneven, and therefore, reliable operation of the wire cannot be expected, particularly in a last half D ("UNSTABLE OPERATION") of the cycle of continuous dots.

Figure 5:
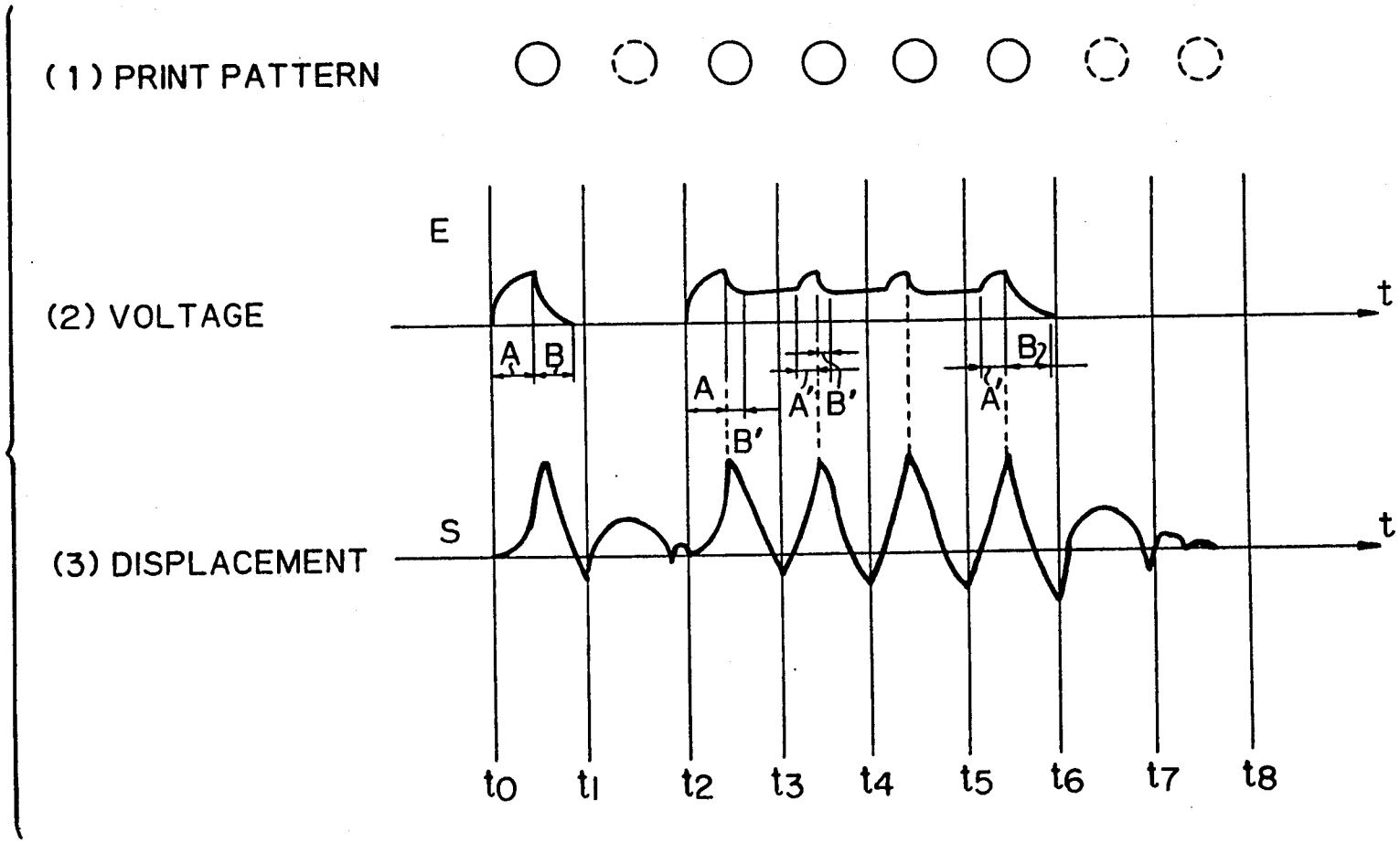
FIG. 5 illustrates operations of a printing head driven according to the present invention.

According to the present invention and as shown in FIG. 2, the printing head controller comprises a data input line buffer 10, a head actuator (actuating time set) 11, a drive circuit 12, a print pattern detector 13, and a dot detector (actuating time set) 14. FIG. 5 illustrates the operation of the printing head of this invention. In FIG. 5, the respective abscissa of plots (1) to (3) indicate the common time (t). Also, in FIG. 5, (1) shows the same dot pattern as in FIG. 4, with respect to the differing sequences of continuous (t2–t3, . . . t5–t6) or discontinuous (t0–t1) dots, i.e., the solid circle indicates the existence of a print dot and the dotted circle indicates the nonexistence of a print dot; (2) illustrates the charging and discharging voltage waveforms, i.e., as produced by the voltage E applied to the electroexpansive element, in this invention; and (3) illustrates the displacement amplitude S of the printing wire. In this invention, in the case of the discontinuous (or single) dot, the charge time T1 and the discharge time T2 are set in the same manner as in the prior art, i.e., T1=A, and T2=B. However, in the case of the continuous dots, the operation is as follows: (i) at the first dot print cycle (t2–t3), the charge time T1 is set to be still the same as A, but the discharge time is shortened to be completed sooner, i.e., the discharge time T2=B′ (B>B′); (ii) at the second dot print cycle and thereafter (t2–t3, . . . t4–t5), except for the last dot print cycle (t5–t6) of the series, the charge time T1 and the discharge time T2 are both shortened, so that each is completed sooner, i.e., the charge time T1=A′ (A>A′) and the discharge time T2=B′ (B>B′); (iii) at the last dot (t5–t6) of the series, only the charge time is shortened, thereby to be completed sooner, and the discharge time is not shortened, i.e., the charge time T1=A′ (A>A′) and the discharge time T2=B.

As mentioned above, with the control according to this invention, if the dot is continuous, the discharge is terminated before the electroexpansive element is fully discharged, and therefore, the shrinkage thereof does not reach the initial condition of the element and correspondingly the printing wire does not return fully to its initial position, and thus the overshoot of the printing wire is prevented. At the next charging and due to the reduction of the charging time to the shorter time interval A′, the mechanical parts of the printing head are not subjected to an excess force and thus the extent, or amplitude, of the wire movement, or displacement, is reduced, or made smaller. Also, at the last dot of the continuous dots, the discharge time is not shortened, and therefore, the electroexpansive element can be fully discharged, and thus a stable and reliable operation of the printing member, i.e., the printing wire, is obtained.

The dot pattern as shown in FIG. 5 (1), and particularly the existence of continuous or discontinuous dots, is detected by the print pattern detector 13 in FIG. 2 before the printing head is actuated and is discriminated by the dot detector ("actuating tme set") 14 which controls the head actuator 11 ("actuating time set") to set the charge time T1 and discharge time T2 to the time values of either A or A′ and B or B′, respectively.

Figure 6:
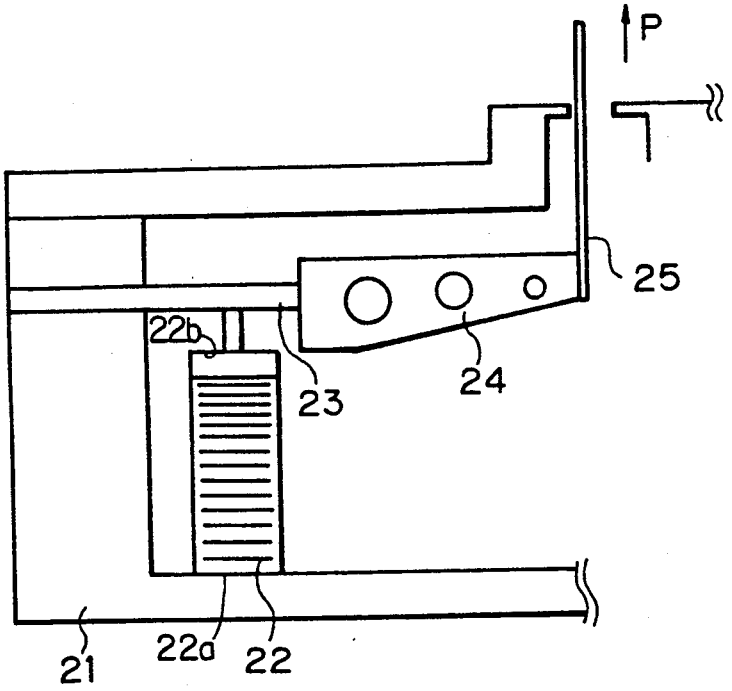
FIG. 6 is a schematic view of a printing head according to a second embodiment of the present invention.
Figure 7:
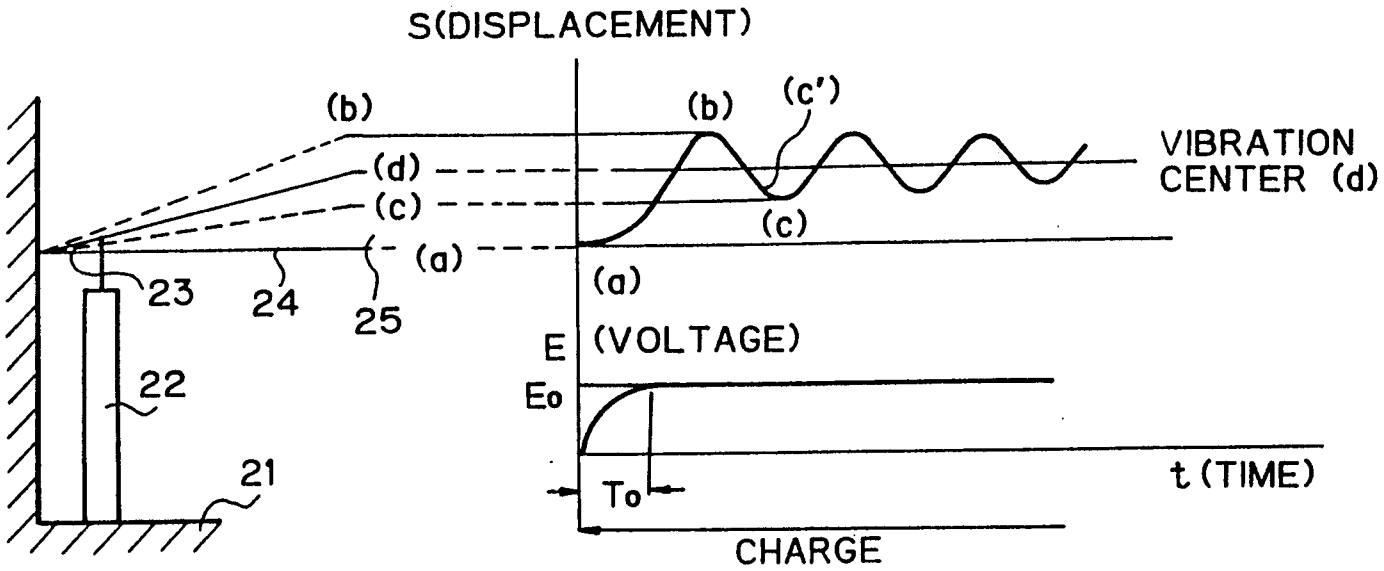
FIG. 7 illustrates an operation of an electroexpansive element when electrically charged.
Figure 8:
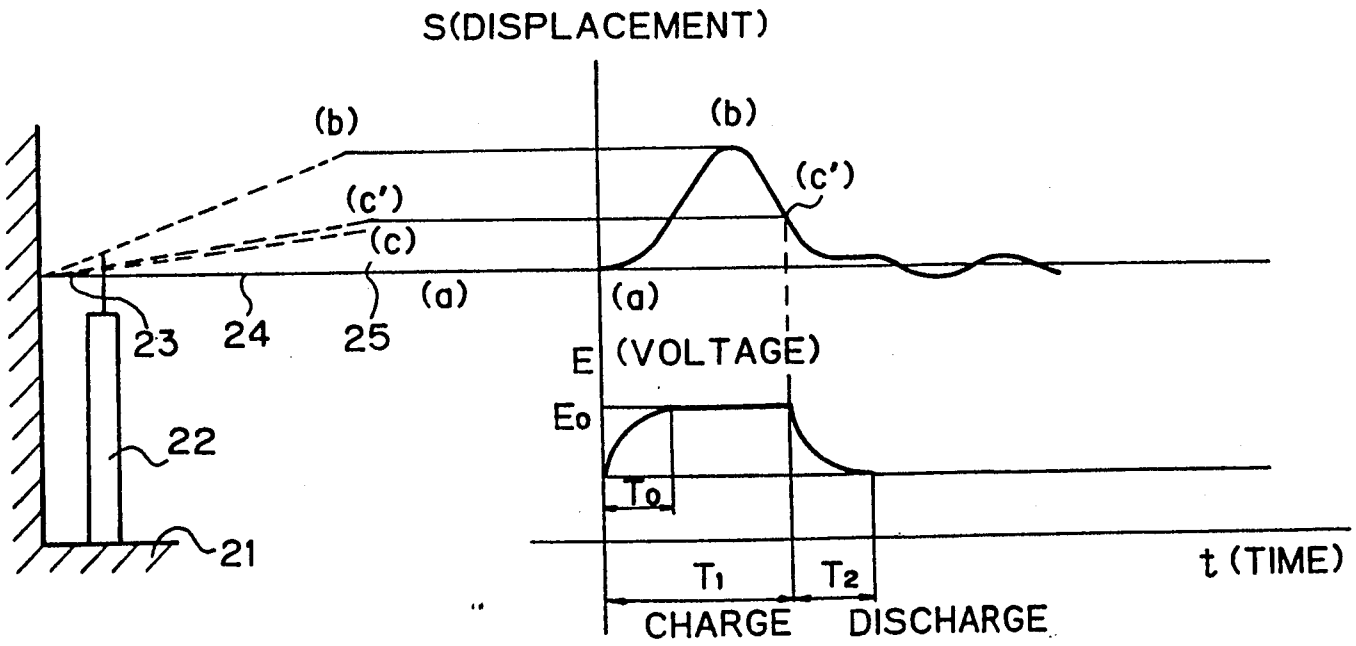
FIG. 8 illustrates an operation of the second embodiment of a printing head of the present invention.

Referring to another embodiment shown in FIGS. 6, 7, and 8, an actuator of a printing head according to this embodiment comprises a base frame 21, an electroexpansive element 22, a leaf spring 23, a movable member (or armature) 24, and an impact printing wire or rod 25. The electroexpansive element 22, such as a piezo-electric device, has a base end **22*a* which is rigidly mounted on the frame base 21 and a top free end 22*b* which is connected to the leaf spring 23 near the fulcrum point thereof, at which it is rigidly supported to the base frame 21, thereby to function as a cantilever. The leaf spring 23 is rigidly connected at the free end thereof to the armature 24, in turn having a free end thereof connected to the printing wire 25. Therefore, in one printing cycle, the displacement of the electroexpansive element 22 is enlarged by the leaf spring 23 and the armature 24, and transmitted to the impact printing wire 25**, in the same manner as the previous embodiment.

When electrical power is applied to the electroexpansive element 22 for charging same, the voltage difference between the respective ends of the element 22 is abruptly increased and reaches a maximum or saturated voltage Eo after a predetermined To, as shown in FIG. 3 or 7. Nevertheless, an electrical discharge is not started immediately after the time To, at which the maximum voltage Eo is obtained; instead, the electrical charging is continued for maintaining the maximum voltage Eo until expiration of a predetermined time period T1 (not shown in FIG. 7) at which the electrical charging then is stopped and the electrical discharging is started. This is because, although the expansion or shrinking stroke of the electroexpansive element 22 is substantially proportional to the voltage applied thereto, and occurs in substantially the same time sequence, the remaining energy due to the deformation of the leaf spring 23 is accumulated in the movement enlarging mechanism including the leaf spring 23 and the armature 24, and therefore, the timing of the electric charging and discharging must be altered. Thus, after the voltage applied to the electroexpansive element 22 reaches the maximum value and saturates, and only when the printing wire 25 thereafter reaches the maximum forward stroke at an impact point thereof, the electrical discharge is started.

According to the electrical charge and discharge timing as mentioned above, however, when the printing wire 25 reaches the maximum forward stroke thereof at an impact point, the electrical discharge is started, as the prior art shown in FIG. 4 (2). Therefore, the force for returning the wire due to the vibration energy remaining in the printing wire itself and the force for returning the wire due to the shrinkage of the electroexpansive element at the discharge timing thereof are accumulated, and therefore, the wire is returned with a relatively large energy sufficient to overshoot the initial position thereof, and thus an overshoot occurs. Thus the amplitude of the wire 25 becomes larger and the accumulated overshoot causes an unstable or unreliable operation of the wire, which thereby reduces the printing quality, as will be seen from FIG. 4 (3).

As shown in FIG. 7, when the electrical power is applied for charging the electroexpansive element 22, the voltage difference between the respective ends of the element 22 is abruptly increased and reaches a maximum or saturated voltage Eo. This maximum voltage Eo is maintained for a predetermined time. The electroexpansive element 22 is expanded according to the voltage applied thereto and the movement thereof is enlarged and transmitted via the leaf spring 23 and the armature 24 to move the printing wire 25 upwardly from the initial position (a) thereof. After the voltage applied to the electroexpansive element 22 reaches the maximum value Eo and the electroexpansive element 22 is almost fully expanded, the printing wire 25 still continues to move upwardly due to the kinetic energy accumulated in the leaf spring 23 and the armature 24, and extends above a central line (d) to reach a maximum forward (upward) stroke point (b) at which the impact or printing operation is conducted.

At this maximum forward stroke point (b), however, the leaf spring 23 and the armature 24 still retains the vibration energy by which the printing wire 25 is to be moved in the opposite direction, i.e., downwardly. Also, the printing wire 25 moves upwardly again from a most retracted point (c), and thus the vibration thereof about the central line (d) is continued and the amplitude thereof is reduced to finally stop on the central line (d), i.e., the "VIBRATION CENTER (d)" as labelled in FIG. 7.

According to this embodiment and as shown in FIG. 8, after the printing wire 5 reaches the maximum forward stroke point (b) and an impact operation is conducted, and immediately before the printing wire 25 reaches the most retracted point (c), i.e., at a point (c') as shown in FIG. 8, the electrical discharge of the electroexpansive element 22 is started. Thus, since the shrinkage of the electroexpansive element 22 is started immediately before (i.e., at point c') the printing wire 25 reaches the most retracted point (c), the forces for moving the printing wire 25 forward (upward) due to the remaining energy and the opposite force for moving it downwardly due to the shrinkage of the electroexpansive element 22 are substantially mutually balanced, so that the remaining energy is considerably reduced.

Therefore, as shown in FIG. 8, the kinetic energy of the printing wire 25 per se is almost extinguished, and therefore, the printing wire 25 can be quickly returned to the initial point (a) thereof. Although not shown in FIG. 8, a small amplitude oscillation, or vibration, of the print wire about the rest position (a) may still occur. However, any such continuing oscillation is of greatly reduced amplitude as compared with the oscillation of the print wire about the vibration center (d) in FIG. 7.

In the above-mentioned embodiment, the leaf spring 23, supported as a cantilever on the frame 21, and the armature 24 cooperatively constitute an enlarging means in which the remaining energy is accumulated; however, this invention is not limited to the specifically disclosed enlarging means of FIG. 6, and instead is generally applicable to a wire-dot printer having another type of enlarging mechanism in which a time-lag occurs between the motion of the electroexpansive element 22, which expands and shrinks according to respective electrical charge and discharge thereof, and the corresponding movement of the printing wire 25, which is driven reciprocally thereby to conduct an impact printing operation.

I claim:

1. An apparatus for driving a printing head of a wire-dot printer, the printing head having plural electroexpansive elements for driving respective dot-impact printing wires which cooperatively constitute a wire-dot matrix, each said electroexpansive element being selectively expanded and shrunk by corresponding, selective electrical charging and discharging thereof, respectively, and thereby undergoing movement and correspondingly moving the respective dot-impact printing wire connected to the electroexpansive element for conducting a dot-printing operation, said apparatus receiving print pattern data designating the existence, or non-existence, of a dot to be printed by the respective, plural dot-impact printing wires in each of a succession of print cycles, and comprising:

means for detecting in the received print pattern data the existence of a dot to be printed by a respective dot-impact printing wire, for each of the plural dot-impact printing wires and in each printing cycle, and for determining whether continuous dots appear throughout a succession of corresponding printing cycles or only a single dot appears in a corresponding printing cycle and thus no dot appears in the next successive printing cycle; and means for setting respective time intervals for selectively, electrically charging and discharging said respective electroexpansive elements of said dot-impact printing wires, individually and in accordance with the received and detected print pattern data and in each of the succession of printing cycles, as follows: in the case of said continuous dots, $T1=A$, $T2=B'$ for a first dot, $T1=A'$, $T2=B'$ for each next successive dot after said first and preceding the last dot, and $T1=A'$, $T2=B$ for said last dot of said continuous dots, and in the case of said single dot, $T1=A$, $T2=B$, wherein T1 is the time for electrical charging, T2 is the time for electrical discharging, $A>A'$, and $B>B'$.

2. A driving apparatus as claimed in claim 1, wherein said apparatus further comprises a frame and a movable member having a first end, defining a first pivot point, pivotably connected to the frame and a second end connected to said impact printing wire, and said electroexpansive element has a base end rigidly connected to the frame and a free end pivotably connected to said movable member at a second pivotal point between said first pivot point and said second end thereof, so that the movement of said electroexpansive element is enlarged by said movable member and transmitted thereby to said impact printing wire.

3. A driving apparatus as claimed in claim 2, wherein the distance from said first pivot point to said second pivot point is smaller than the distance from said second pivot point to said second end of said movable member to which said impact printing wire is connected.

4. A driving apparatus as claimed in claim 2, wherein said frame is substantially L-shaped, having a base and a side wall extending substantially perpendicularly to said base, said electroexpansive element is rigidly mounted on said base, and said movable member is pivotably connected to the top of said side wall at said first pivot point.

5. An apparatus for driving a printing head of a wire-dot printer, the printing head having plural electroexpansive elements for driving respective dot-impact printing wires which cooperatively constitute a wire-dot matrix, each said electroexpansive element being selectively expanded and shrunk by corresponding, selective electrical charging and discharging thereof, respectively, and thereby undergoing movement and correspondingly moving the respective dot-impact printing wire connected to the electroexpansive element for conducting a dot-printing operation, said apparatus receiving print pattern data designating the existence, or non-existence, of a dot to be printed by the respective, plural dot-impact printing wires in each of a succession of print cycles, and comprising:

means for detecting in the received print pattern data the existence of a dot to be printed by a respective dot-impact printing wire, for each of the plural dot-impact printing wires and in each printing cycle, and for determining whether continuous dots appear throughout a succession of corresponding printing cycles or only a single dot appears in a corresponding printing cycles or only a single dot appears in a corresponding printing cycle and thus no dot appears in the next successive printing cycle; and means for setting respective time intervals for selectively, electrically charging and discharging said respective electroexpansive elements of said dot-impact printing wires, in accordance with the received and detected print pattern data and in each of the succession of printing cycles, as follows: in the case of said continuous dots, $T1=A$, $T2=B'$ for a first dot, and in the case of said single dot, $T1=A$, $T2=B$, wherein T1 is the time for electrical charging, T2 is the time for electrical discharging, and $B>B'$.

* * * * *

UNITED STATES PATENT AND TRADEMARK OFFICE

CERTIFICATE OF CORRECTION

PATENT NO. : 5,078,520

DATED : January 7, 1992

INVENTOR(S) : Akio YANO et al.

It is certified that error appears in the above-identified patent and that said Letters Patent is hereby corrected as shown below:

Item [57] ABSTRACT:

line 14, change "T2-B'" to --T2 = B'--;
line 15, change "T2-B'" to --T2 = B'--;
line 16, change "T2-B" to --T2 = B--.

Col. 1, line 32, after "or" insert --a--.

Col. 9, line 13, delete "or only a single dot appears in a";
line 14, delete "corresponding printing cycles".

Signed and Sealed this

Twenty-sixth Day of October, 1993

*Attest:*

*Attesting Officer*

BRUCE LEHMAN

*Commissioner of Patents and Trademarks*